US006345457B1

(12) United States Patent
Bradley

(10) Patent No.: US 6,345,457 B1
(45) Date of Patent: Feb. 12, 2002

(54) DECORATIVE ARTICLE FOR SIMULATING A SNOW SCENE

(76) Inventor: William P. Bradley, 730 Union St., Brooklyn, NY (US) 11215

( * ) Notice: Subject to any disclaimer, the term of this patent is extended or adjusted under 35 U.S.C. 154(b) by 0 days.

(21) Appl. No.: 09/498,971

(22) Filed: Feb. 7, 2000

(51) Int. Cl.[7] ..... G09F 19/00
(52) U.S. Cl. ..... 40/410; 40/442
(58) Field of Search ..... 40/406, 407, 409, 40/410, 442, 443, 540

(56) References Cited

U.S. PATENT DOCUMENTS

| | | | | | |
|---|---|---|---|---|---|
| 883,865 | A | * | 4/1908 | Dahn et al. | 40/540 |
| 1,700,328 | A | * | 1/1929 | Nicholson | 40/540 |
| 3,220,130 | A | * | 11/1965 | Falkenberg | 40/540 |
| 4,641,445 | A | * | 2/1987 | Rossi | 40/410 |
| 4,817,311 | A | * | 4/1989 | Ong | 40/410 |
| 4,869,005 | A | | 9/1989 | Valentino | 40/406 |
| 5,200,239 | A | | 4/1993 | Chen | 428/13 |
| 5,291,674 | A | | 3/1994 | Torrence | 40/410 |
| 5,313,727 | A | * | 5/1994 | Murray, Jr. | 40/410 |
| 5,412,888 | A | | 5/1995 | Rickuss et al. | 40/410 |
| 5,632,419 | A | * | 5/1997 | Pickens | 222/189.05 |
| 5,666,750 | A | | 9/1997 | Segan et al. | 40/410 |
| 5,711,099 | A | * | 1/1998 | Nesbit et al. | 40/406 |
| 5,864,976 | A | * | 2/1999 | Yang | 40/410 |

* cited by examiner

*Primary Examiner*—Lynne H. Browne
*Assistant Examiner*—Kenn Thompson
(74) *Attorney, Agent, or Firm*—Richard L. Miller

(57) ABSTRACT

A decorative article for simulating a snow scene. The article includes a housing, a figurine, simulated snow, circulating apparatus, and illuminating apparatus. The figurine and the simulated snow are disposed in the housing, and the figurine is supported on a figurine support therein. The circulating apparatus is disposed in the housing and circulates the simulated snow therearound. The illuminating apparatus is disposed in, and illuminates, the housing. The circulating apparatus includes the housing having at least one vent throughbore, a reflector that has a lower convex surface that rests centrally on the bottom wall of the housing, a pair of ends that rise to the distance of the figurine support and contact the pair of side walls of the housing, respectively, and an upper concave surface that faces the figurine, a fan that is disposed between the reflector and the figurine support, and a shield that is disposed between the fan and the figurine support and prevents the simulated snow from passing through the fan and becoming pulverized. When the fan is activated, the simulated snow is caused to reflect off of the reflector, circulate throughout the housing, around the figurine, and simulate a snow storm.

13 Claims, 2 Drawing Sheets

FIG.4
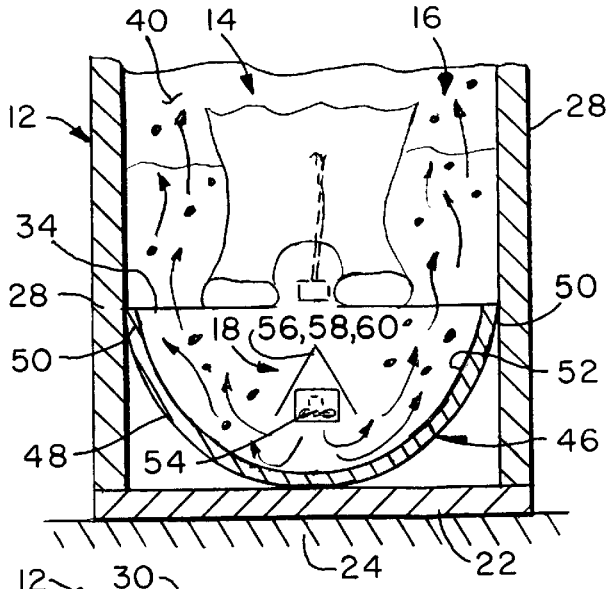
FIG.5
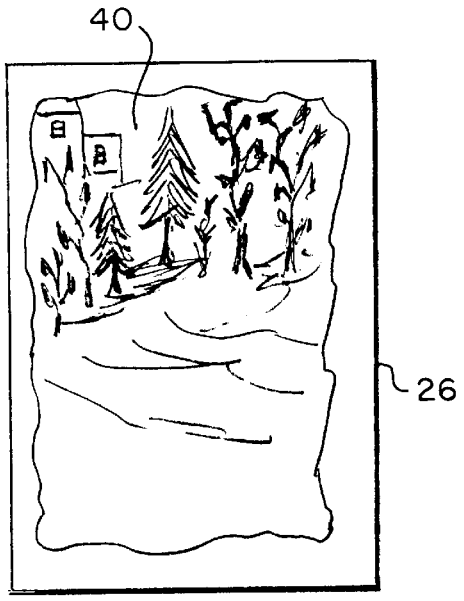
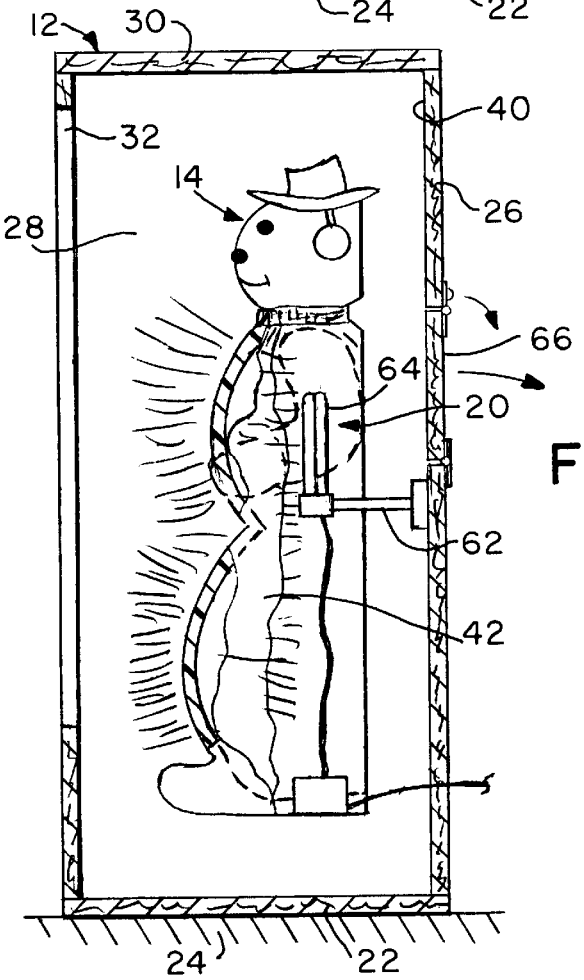
FIG.6

DECORATIVE ARTICLE FOR SIMULATING A SNOW SCENE

BACKGROUND OF THE INVENTION

1. Field of the Invention

The present invention relates to a decorative article. More particularly, the present invention relates to a decorative article for simulating a snow screen.

2. Description of the Prior Art

Numerous innovations for snow related devices have been provided in the prior art that will be described. Even though these innovations may be suitable for the specific individual purposes to which they address, however, they differ from the present invention.

A FIRST EXAMPLE, U.S. Pat. No. 4,869,005 to Valentino teaches a novelty device for representing an outdoor scene that includes an outer portion configured to resemble the interior of a room and having an opening which may represent a door or a window for viewing the outdoor scene. An inner portion is positioned behind this opening, and the inner portion contains artwork representing the outdoor scene and a fluid containing particles adapted to be spread throughout the fluid. In this way, the inner portion can be shaken to spread the particles throughout the fluid so that they may settle by gravity to resemble falling objects such as snow or autumn leaves traditionally found in the outdoors. The inner piece may be divided into two compartments which represent different seasons of the same outdoor scene and, in this way, the inner piece can be removed with either of its scenes positioned behind the opening to illustrate either of two outdoor scenes.

A SECOND EXAMPLE, U.S. Pat. No. 5,200,239 to Chen teaches a decoration article with an automatic flaking device that has a bottom basin in which are disposed a battery power source and a motor and an electric circuit including a sound actuating device; and a flake circulating tube having a top outlet and a bottom inlet disposed at both ends thereof with the bottom inlet in contact with an inclined surface disposed on top of the bottom basin is provided with a screw conveyor by which the snow flakes are delivered to the top of the circulating tube and a dispersing device secured to the upper end of the screw conveyer is employed to disperse the flakes evenly via an obliquely located guide plate so that a continual snowing scene can be created with the addition of sound and light effects, making the decoration article more appealing and fascinating.

A THIRD EXAMPLE, U.S. Pat. No. 5,291,674 to Torrence teaches a display formed of two colorless, transparent plastic cylinders that are mounted concentrically with a vertical axis upon a base. The space between the two cylinders forms a tank which is filled with liquid and some plastic snowflakes having a slightly greater specific gravity than the liquid. An object to be displayed is positioned within the inner cylinder and, so, is not in contact with the liquid. The object and the liquid are illuminated by a light within the base. A motor operates a pump having an encased spiral rotor projecting vertically downwardly into the liquid. Rotation of the pump causes a diffuse upward flow of the liquid and the snowflakes in the vicinity of the pump. Though this causes the snowflakes to move upwardly in a gentle and diffuse manner, this motion isn't particularly notices by an observer. When the snowflakes reach the top of the liquid, they are diffused sidewardly and begin dripping, creating a snowfall effect.

A FOURTH EXAMPLE, U.S. Pat. No. 5,412,888 to Rickuss et al. teaches an assembly for producing an artificial snowfall in a Christmas tree display arrangement that is stored as a pack having a base with a carrying handle and a lid adapted to fit over the base. Within the latter is an air blower unit comprising an electric motor and fan located below a cover, moving air from externally to a fan outlet and thereafter into an air transporting tube assembly provided with a venturi, through an aperture in the cover. A Christmas tree can locate through a central aperture in the cover onto a stand within the base. Artificial snow in the form of plastics beads is available on the cover and can be moved through the venturi to the top of the tree, from where the beads fall by gravity through the tree to be collected by the cover and its petal sections.

A FIFTH EXAMPLE, U.S. Pat. No. 5,666,750 to Segan et al. teaches an ornamental display device for simulating snowfall over a display object or scene positioned within a housing that comprises a liquid filled compartment rotatably arranged within the housing. The compartment includes first and second opposed sidewalls having aligned transparent portions defining a sealed interior cavity for receiving the liquid. The liquid within the cavity is substantially transparent and a plurality of snow-simulating flake particles are dispersed within the liquid. Blade members radially arranged within the compartment are oriented at a predetermined angle so as to transport flake particles from the lower zone of the cavity to the upper zone as the compartment is rotated. The transparent sidewall portions are aligned with the display object or scene so that the object or scene can be viewed during continuous recirculation of the flake particles.

It is apparent that numerous innovations for snow related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a decorative article for simulating a snow screen that avoids the disadvantages of the prior art.

ANOTHER OBJECT of the present invention is to provide a decorative article for simulating a snow screen that is simple and inexpensive to manufacture.

STILL ANOTHER OBJECT of the present invention is to provide a decorative article for simulating a snow screen that is simple to use.

BRIEFLY STATED, YET ANOTHER OBJECT of the present invention is to provide a decorative article for simulating a snow scene. The article includes a housing, a figurine, simulated snow, circulating apparatus, and illuminating apparatus. The figurine and the simulated snow are disposed in the housing, and the figurine is supported on a figurine support therein. The circulating apparatus is disposed in the housing and circulates the simulated snow therearound. The illuminating apparatus is disposed in, and illuminates, the housing. The circulating apparatus includes the housing having at least one vent throughbore, a reflector that has a lower convex surface that rests centrally on the bottom wall of the housing, a pair of ends that rise to the distance of the figurine support and contact the pair of side walls of the housing, respectively, and an upper concave surface that faces the figurine, a fan that is disposed between the reflector and the figurine support, and a shield that is disposed between the fan and the figurine support and prevents the simulated snow from passing through the fan and becoming pulverized. When the fan is activated, the simulated snow is caused to reflect off of the reflector, circulate throughout the housing, around the figurine, and simulate a snow storm.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 4 is a diagrammatic cross sectional view taken on line 4—4 in FIG. 3;

FIG. 5 is a diagrammatic front elevational view taken generally in the direction of arrow 5 in FIG. 3; and FIG. 6 is an enlarged diagrammatic cross sectional view taken on line 6—6 in FIG. 2.

LIST OF REFERENCE NUMERALS UTILIZED IN THE DRAWING

Figure 1:
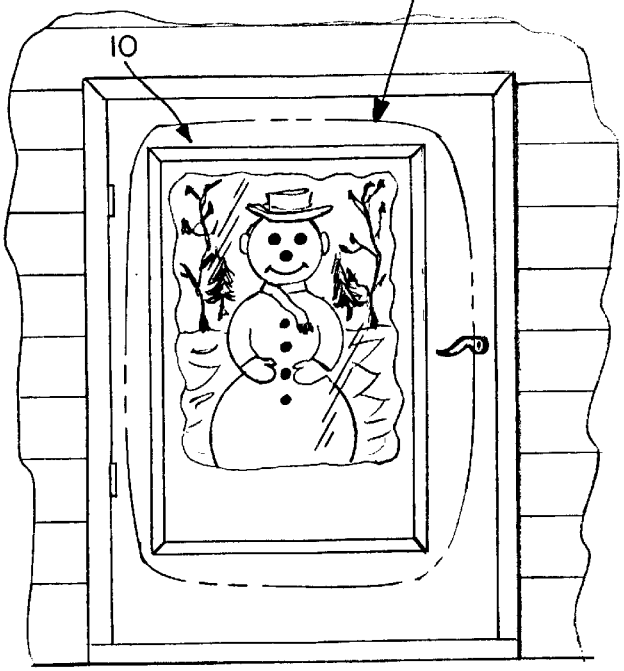
FIG. 1 is a diagrammatic front elevational view of the present invention in use.
Figure 3:
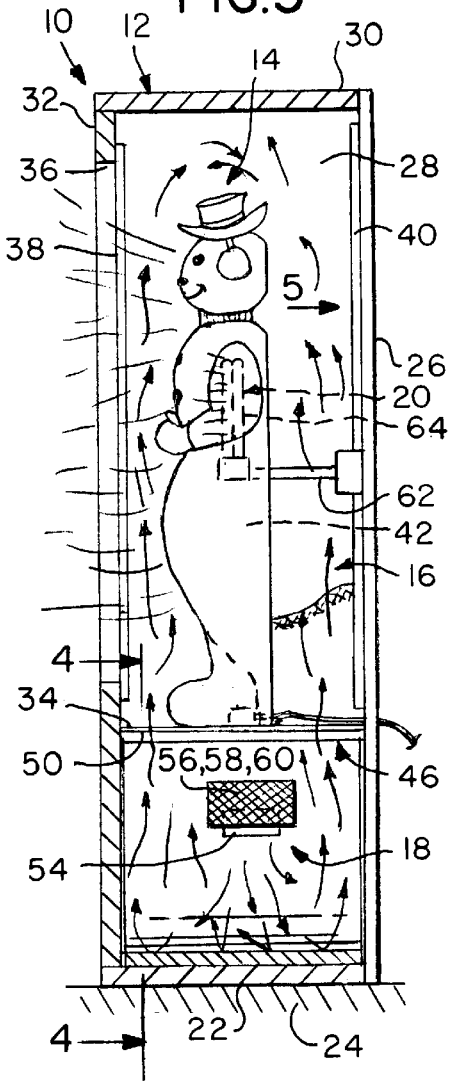
FIG. 3 is an enlarged diagrammatic cross sectional view taken on line 3—3 in FIG. 2.
Figure 2:
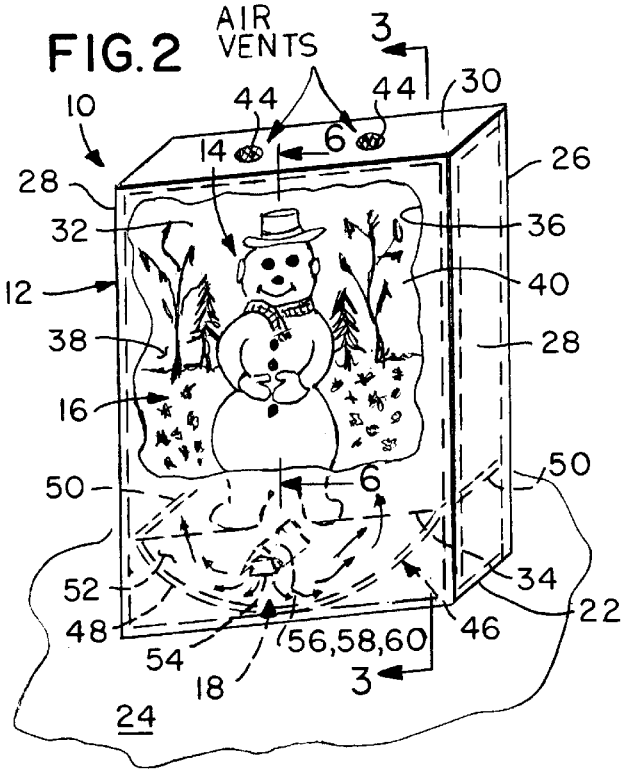
FIG. 2 is a diagrammatic perspective view of the area generally enclosed by the dotted curve identified by arrow 2 in FIG. 1 of the present invention.

10 decorative article of the present invention for simulating snow screen
12 housing
14 figurine
16 simulated snow
18 circulating apparatus
20 illuminating apparatus
22 bottom wall of housing 12 for resting on surface 24
24 surface
26 back wall of housing 12
28 pair of side walls of housing 12
30 top wall of housing 12
32 front wall of housing 12
34 figurine support in housing 12
36 figurine-viewing throughbore in front wall 32 of housing 12
38 transparent panel filling figurine-viewing throughbore 36 in front wall 32 of housing 12
40 snow scene on back wall 26 of housing 12
42 hollowed-out back of figurine 14
44 at least one vent throughbore in top wall 30 of housing 12
46 reflector of circulating apparatus 18
48 lower convex surface of reflector 46 of circulating apparatus 18
50 pair of ends of reflector 46 of circulating apparatus 18
52 upper concave surface of reflector 46 of circulating apparatus 18
54 fan of circulating apparatus 18
56 shield of circulating apparatus 18
58 screen of shield 56 of circulating apparatus 18
60 filter material wrapping screen 58 of shield 56 of circulating apparatus 18
62 lamp support of illuminating apparatus 20
64 at least one lamp of illuminating apparatus 20
66 door in back wall of housing 12

DETAILED DESCRIPTION OF THE PREFERRED EMBODIMENT

Referring now to the figures, in which like numerals indicate like parts, and particularly to FIG. 1, the decorative article of the present invention is shown generally at 10 for simulating a snow screen.

The configuration of the decorative article 10 can best be seen in FIGS. 2–6, and as such, will be discussed with reference thereto.

The decorative article 10 comprises a housing 12, a figurine 14 that is disposed in the housing 12, simulated snow 16 that is disposed in the housing 12, circulating apparatus 18 that is disposed in the housing 12 and circulates the simulated snow 16 therearound, and illuminating apparatus 20 that is disposed in, and illuminates, the housing 12.

The housing 12 is hollow, rectangular-parallelepiped-shaped, and has a bottom wall 22 for resting on a surface 24, a back wall 26 that extends upwardly from the bottom 22 wall of the housing 12, a pair of side walls 28 that extend upwardly from the bottom wall 22 of the housing 12, a top wall 30 that is disposed above the bottom wall 22 of the housing 12, and a front wall 32 that is disposed in front of the back wall 26 of the housing 12.

The housing 12 further has a figurine support 34 that extends transversely therein, a distance above the bottom wall 22 of the housing 12.

The front wall 32 of the housing 12 has a figurine-viewing throughbore 36 that occupies a majority thereof, and is disposed between the figurine support 34 in the housing 12 and the top wall 30 of the housing 12.

The figurine-viewing throughbore 36 in the front wall 32 of the housing 12 is filled with a transparent panel 38.

The back wall 26 of the housing 12 has a snow scene 40 thereon that extends from the figurine support 34 in the housing 12 to the top wall 30 of the housing 12, and is viewed through the transparent panel 38 in the figurine-viewing throughbore 36 in the front wall 32 of the housing 12.

The figurine 14 is supported by the figurine support 34 in the housing 12, and extends upwardly therefrom, to short of the top wall 30 of the housing 12.

The figurine 14 is at least translucent, shaped like a snowman to coordinate with the snow scene 40 on the back wall 26 of the housing 12, faces, but is spaced rearwardly from, the transparent panel 38 in the figurine-viewing throughbore 36 in the front wall 32 of the housing 12, and has a hollowed-out back 42 that faces, but is spaced forwardly of, the back wall 26 of the housing 12.

The simulated snow 16 is small styrofoam pellets.

The circulating apparatus 18 includes the top wall 30 of the housing 12 having at least one vent throughbore 44.

The circulating apparatus 18 further includes a reflector 46 that is a strip bent into a concavo-convex-shape, and extends arcuately from one side wall 28 of the housing 12 to the other side wall 28 of the housing, and linearly from the front wall 32 of the housing 12 to the back wall 26 of the housing 12.

The reflector 46 of the circulating apparatus 18 has a lower convex surface 48 that rests centrally on the bottom wall 22 of the housing 12, a pair of ends 50 that rise to the distance of the figurine support 34 in the housing 12 and contact the pair of side walls 28 of the housing 12, respectively, and an upper concave surface 52 that faces the figurine 14.

The circulating apparatus 18 further includes a fan 54 that is disposed between the reflector 46 of the circulating apparatus 18 and the figurine support 34 in the housing 12, and is pointed downwardly towards the reflector 40 of the circulating apparatus 18.

When the fan 54 of the circulating apparatus 18 is activated, the simulated snow 16 is caused to reflect off of the reflector 40 of the circulating apparatus 18, circulate throughout the housing 12, around the figurine 14, and simulate a snow storm.

The circulating apparatus 18 further includes a shield 56 that is disposed between the fan 54 of the circulating apparatus 18 and the figurine support 34 in the housing 12, extends linearly from the front wall 32 of the housing 12 to the back wall 26 of the housing 12, and prevents the simulated snow 16 from passing through the fan 54 of the circulating apparatus 18 and becoming pulverized.

The shield 56 of the circulating apparatus 18 is inverted V-shaped when viewed from the front wall 32 of the housing 12 and the back wall 26 of the housing 12, and is spaced from the pair of side walls 28 of the housing so as to allow the simulated snow 16 to circulate therepast.

The shield 56 of the circulating apparatus 18 is made of a screen 58 wrapped with a filter material 60.

The illuminating apparatus 20 includes a lamp support 62 that extends forwardly from the back wall 26 of the housing 12, into the hollowed-out back 42 of the figurine 14.

The illuminating apparatus 20 further includes at least one lamp 64 that is disposed on the lamp support 62 of the illuminating apparatus 20, in the figurine 14.

When the at least one lamp 64 of the illuminating apparatus 20 is illuminated, the figurine 18 illuminates.

The illuminating apparatus 20 further includes the back wall 26 of the housing 12 having a door 66, and when the door 66 in the back wall 26 of the housing 12 is opened, access to service the at least one lamp 64 of the illuminating apparatus 20 is afforded.

It will be understood that each of the elements described above, or two or more together, may also find a useful application in other types of constructions differing from the types described above.

While the invention has been illustrated and described as embodied in a decorative article for simulating a snow screen, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A decorative article for simulating a snow scene, comprising:

a) a housing;

b) a figurine disposed in said housing;

c) simulated snow disposed in said housing;

d) circulating apparatus disposed in said housing and circulating said simulated snow therearound; and e) illuminating apparatus disposed in, and illuminating, said housing, wherein said housing is hollow, rectangular-parallelepiped-shaped, and has:

i) a bottom wall for resting on a surface;

ii) a back wall extending upwardly from said bottom wall of said housing;

iii) a pair of side walls extending upwardly from said bottom wall of said housing;

iv) a top wall that is disposed above said bottom wall of said housing; and v) a front wall that is disposed in front of said back wall of said housing, wherein said housing further has a figurine support that extends transversely therein, a distance above said bottom wall of said housing, wherein said front wall of said housing has a figurine-viewing throughbore that occupies a majority thereof, and is disposed between said figurine support in said housing and said top wall of said housing, wherein said back wall of said housing has a snow scene thereon that extends from said figurine support in said housing to said top wall of said housing, and is viewed through said transparent panel in said figurine-viewing throughbore in said front wall of said housing, wherein said figurine is at least translucent, shaped like a snowman to coordinate with said snow scene on said back wall of said housing, faces, but is spaced rearwardly from, said transparent panel in said figurine-viewing throughbore in said front wall of said housing, and has a hollowed-out back that faces, but is spaced forwardly of, said back wall of said housing.

2. A decorative article for simulating a snow scene, comprising:

A) a housing;

B) a figurine disposed in said housing;

C) simulated snow disposed in said housing;

D) circulating apparatus disposed in said housing and circulating said simulated snow therearound; and E) illuminating apparatus disposed in, and illuminating, said housing, wherein said housing is hollow, rectangular-parallelepiped-shaped, and has:

i) a bottom wall for resting on a surface;

ii) a back wall extending upwardly from said bottom wall of said housing;

iii) a pair of side walls extending upwardly from said bottom wall of said housing;

iv) a top wall that is disposed above said bottom wall of said housing; and v) a front wall that is disposed in front of said back wall of said housing, wherein said housing further has a figurine support that extends transversely therein, a distance above said bottom wall of said housing, wherein said circulating apparatus includes a reflector that is a strip bent into a concavo-convex-shape, and extends arcuately from one side wall of said housing to the other side wall of said housing, and linearly from said front wall of said housing to said back wall of said housing, wherein said reflector of said circulating apparatus has:

a) a lower convex surface that rests centrally on said bottom wall of said housing;

b) a pair of ends that rise to said distance of said figurine support in said housing and contact said pair of side walls of said housing, respectively; and c) an upper concave surface that faces said figurine.

3. The article as defined in claim 1, wherein said simulated snow is small polystyrene foam pellets.

4. The article as defined in claim 1, wherein said circulating apparatus includes said top wall of said housing having at least one vent throughbore.

5. The article as defined in claim 3, wherein said circulating apparatus includes a reflector that is a strip bent into a concavo-convex-shape, and extends arcuately from one side wall of said housing to the other side wall of said housing, and linearly from said front wall of said housing to said back wall of said housing.

6. The article as defined in claim 2 wherein said circulating apparatus further includes a fan that is disposed between said reflector of said circulating apparatus and said figurine support in said housing, and is pointed downwardly towards said reflector of said circulating apparatus, and when said fan of said circulating apparatus is activated, said simulated snow is caused to reflect off of said reflector of said circulating apparatus, circulate throughout said housing, around said figurine, and simulate a snow storm.

7. The article as defined in claim 6 wherein said circulating apparatus further includes a shield that is disposed between said fan of said circulating apparatus and said figurine support in said housing, extends linearly from said front wall of said housing to said back wall of said housing, and prevents said simulated snow from passing through said fan of said circulating apparatus and becoming pulverized.

8. The article as defined in claim 7 wherein said shield of said circulating apparatus is inverted V-shaped when viewed from said front wall of said housing and said back wall of said housing, and is spaced from said pair of side walls of said housing so as to allow said simulated snow to circulate therepast.

9. The article as defined in claim 7 wherein said shield of said circulating apparatus is made of a screen wrapped with a filter material.

10. The article as defined in claim 1, wherein said illuminating apparatus includes a lamp support that extends forwardly from said back wall of said housing, into said hollowed-out back of said figurine.

11. The article as defined in claim 10, wherein said illuminating apparatus further includes at least one lamp that is disposed on said lamp support of said illuminating apparatus, in said figurine, and when said at least one lamp of said illuminating apparatus is illuminated, said figurine illuminates.

12. The article as defined in claim 11, wherein said illuminating apparatus further includes said back wall of said housing having a door, and when said door in said back wall of said housing is opened, access to service said at least one lamp of said illuminating apparatus is afforded.

13. The article as defined in claim 1, wherein said figurine is supported by said figurine support in said housing, and extends upwardly therefrom, to short of said top wall of said housing.

* * * * *